US006855065B1

(12) United States Patent
Hamilton

(10) Patent No.: US 6,855,065 B1
(45) Date of Patent: Feb. 15, 2005

(54) CIRCULAR ARC GOLF SWING GUIDE AND METHOD

(76) Inventor: David Joseph Hamilton, 422 County Rd. 501, Shannon, MS (US) 38868

( * ) Notice: Subject to any disclaimer, the term of this patent is extended or adjusted under 35 U.S.C. 154(b) by 0 days.

(21) Appl. No.: 10/759,662

(22) Filed: Jan. 17, 2004

(51) Int. Cl.[7] ..... A63B 69/36
(52) U.S. Cl. ..... 473/258; 473/229
(58) Field of Search ..... 473/226, 229, 473/258, 219, 257, 260; 482/112, 115, 118, 119; 434/252; 188/82.7

(56) References Cited

U.S. PATENT DOCUMENTS

| | | | | |
|---|---|---|---|---|
| 1,983,920 A | | 12/1934 | Perin | |
| 2,472,065 A | | 6/1949 | Cottingham | |
| 2,737,432 A | | 3/1956 | Jenks | |
| 2,840,379 A | | 6/1958 | Santoro | |
| 3,319,963 A | | 5/1967 | Cockburn | |
| 3,415,523 A | | 12/1968 | Boldt | |
| 3,604,712 A | | 9/1971 | Prior | |
| 3,718,333 A | | 2/1973 | Santoro et al. | |
| 3,738,661 A | * | 6/1973 | Moller | 473/229 |
| 4,261,573 A | * | 4/1981 | Richards | 473/229 |
| 5,139,264 A | | 8/1992 | Wootten | |
| 5,188,367 A | | 2/1993 | Gipe et al. | |
| 5,301,948 A | * | 4/1994 | Hundley | 473/229 |
| D387,835 S | | 12/1997 | Abram et al. | |
| 6,595,865 B2 | | 7/2003 | Stitz | |
| 2003/0114238 A1 | * | 6/2003 | Meneghini | 473/257 |

* cited by examiner

*Primary Examiner*—Gregory Vidovich
*Assistant Examiner*—Nini F. Legesse
(74) *Attorney, Agent, or Firm*—John V. Stewart

(57) ABSTRACT

A golf putting practice guide that holds a golf club in a putting position, and allows a golfer to perform putting strokes about a single axis that passes between the shoulders of the golfer. No wrist rotation, cocking, or any other additional freedom of motion is permitted by this device. A vertical support holds a pivot bearing at about head level, and a guide arm depends from the pivot. The lower end of the guide arm firmly clamps a golf putting club shaft without blocking the golfer's view of the club head. Adjustments are provided to orient the pivot axis angle and height so that a perpendicular line drawn from the club head to the pivot axis meets the axis between the golfer's shoulders. The club head then swings in a perfect circular arc in a swing plane that passes through the golfer's shoulders.

4 Claims, 3 Drawing Sheets

CIRCULAR ARC GOLF SWING GUIDE AND METHOD

BACKGROUND OF THE INVENTION

1. Field of the Invention

This invention relates to golf stroke practice guide arms that guide a golf club in a desired putting stroke.

2. Description of Prior Art

A patent search by the Applicant's agent returned 12 relevant patents. At first glance some of these look highly similar to Applicant's guide. However, none of them can provide the restricted guidance that is the purpose of Applicant's device. The Applicant's device only allows one degree of freedom. All prior devices have additional degrees of freedom via ball joints, additional pivots, slides, or the like.

For example, U.S. Pat. No. 3,319,963 (Cockburn 1967) shows a golf swing guide that looks similar to Applicant's guide. However, Cockburn (FIG. 2) has a wrist turning pivot and a wrist cocking pivot. In contrast, Applicant's guide does not allow the club to twist, cock, or slide, and it prevents the club head from lifting out of a perfect circular arc.

Other relevant prior patents found include U.S. Pat. No. 2,472,065 (Cottingham 1949), U.S. Des. 387,835 (Abram et al. 1997), U.S. Pat. No. 5,139,264 (Wooten 1992), U.S. Pat. No. 2,737,432 (Jenks 1956), U.S. Pat. No. 6,595,865 (Stitz 2003), and U.S. Pat. No. 5,188,367 (Gipe et al 1993).

None of these can provide the guidance of Applicant's device. For examples, see the ball and socket joints in Stitz FIG. 5. See the ball and socket joint in Abram FIG. 1. These devices cannot firmly restrict the club motion to a single axis of rotation. The present invention provides a novel type of golf stroke guidance that is neither duplicated by the prior art nor suggested by it.

SUMMARY OF THE INVENTION

The main object of this invention is to provide a golf putting practice device that physically guides a golf club head in a perfect circular arc with only a single degree of freedom. Further objects include portability, convenience, low expense, and low maintenance.

These objectives are achieved by provision of a golf putting practice guide that holds a golf club in a putting position, and allows a golfer to perform putting strokes about a single axis that passes between the shoulders of the golfer. No wrist rotation, cocking, or any other additional freedom of motion is permitted by this device. A vertical support holds a pivot bearing at about head level, and a guide arm depends from the pivot. The lower end of the guide arm firmly clamps a golf putting club shaft without blocking the golfer's view of the club head. Adjustments are provided to orient the pivot axis angle and height so that a perpendicular line drawn from the club head to the pivot axis meets the axis between the golfer's shoulders. The club head then swings in a perfect circular arc in a swing plane that passes through the golfer's shoulders.

REFERENCE NUMBERS

| | |
|---|---|
| 1. | Standing pad |
| 2. | Support pole or frame |
| 2a. | Base of support pole |
| 2b. | Lower section of support pole |
| 2c. | Upper telescoping section of support pole |
| 3. | Guide arm pivot |
| 3a. | Guide arm pivot axle |
| 3b. | Guide arm pivot bearing |
| 3c. | Guide arm pivot bearing case |
| 3d. | Guide arm pivot beading preload nut or sleeve |
| 4. | Guide arm |
| 4a. | Guide arm position adjustment sleeve |
| 4b. | Guide arm upper part |
| 4c. | Guide arm middle part |
| 4d. | Guide arm lower part |
| 5. | Golf club shaft clamp assembly |
| 5a. | Golf club shaft clamp |
| 5b. | Clamp arm junction plate |
| 5c. | Clamp position adjustment sleeve |
| 5d. | Upper offset arm for clamp |
| 5e. | Lower offset arm for clamp |
| 5f. | Angle adjustment pivot for damp arms |
| 5g. | Angle adjustment locking lever for clamp arms |
| 7. | Angle adjustment pivot for guide arm |
| 7a. | Angle adjustment locking lever for guide arm |
| 7b. | Angle indicia showing the angle of the guide arm from vertical |
| 8. | Tightening knob |
| 20. | Golf ball |
| 21. | Golf club head |
| 22. | Golf club grip |
| 23. | Golf club shaft |
| A. | Axis of golf stroke rotation. |
| B. | Horizontal distance from shoulders to ball. |
| C. | Circular path followed by putter head. |
| R. | Radius of circular path of putter head. |
| H. | Height of golfer's shoulders in a stroke address stance. |

DETAILED DESCRIPTION

Figure 1:
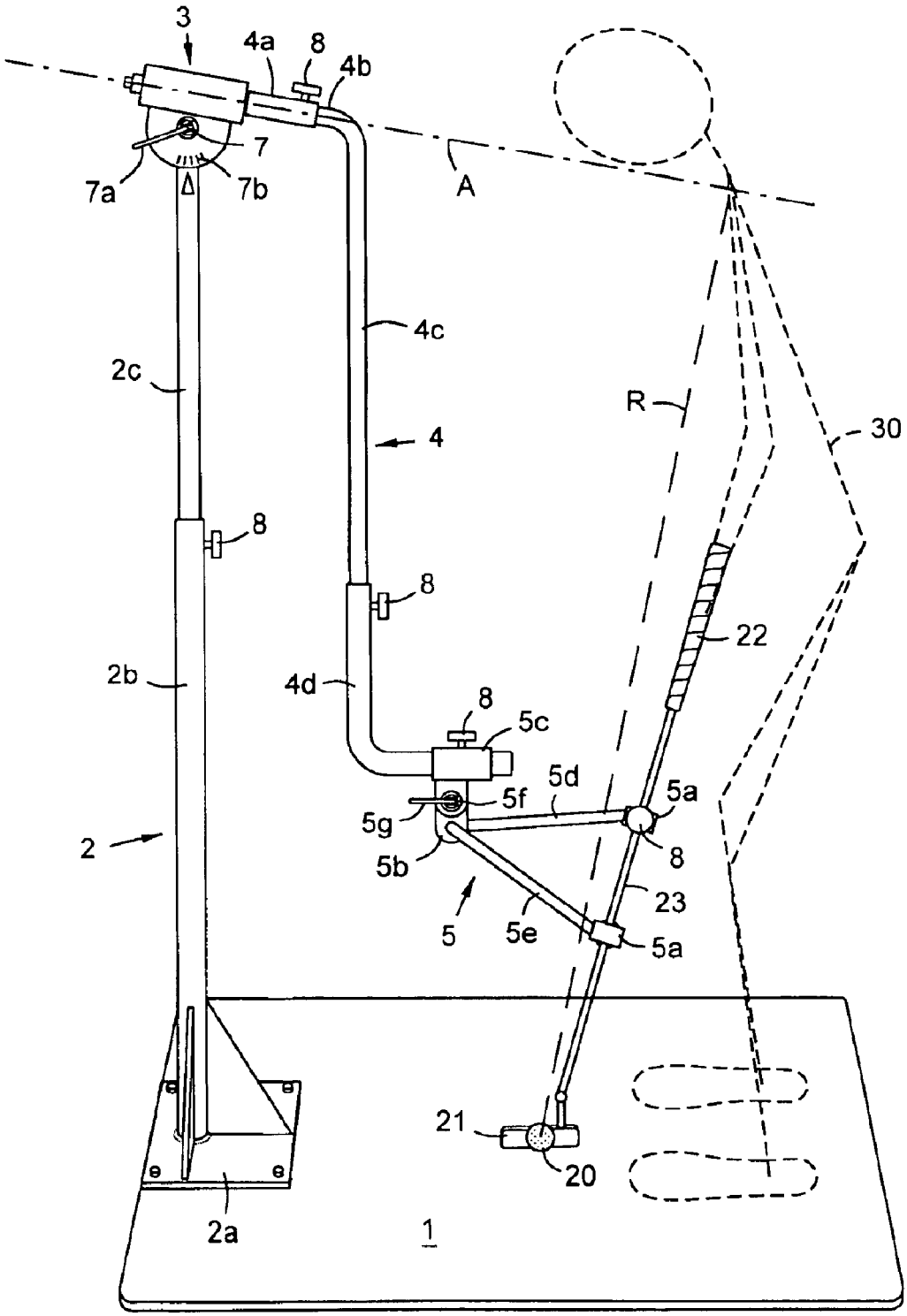
FIG. 1 is a side view of the invention in use.
Figure 2:
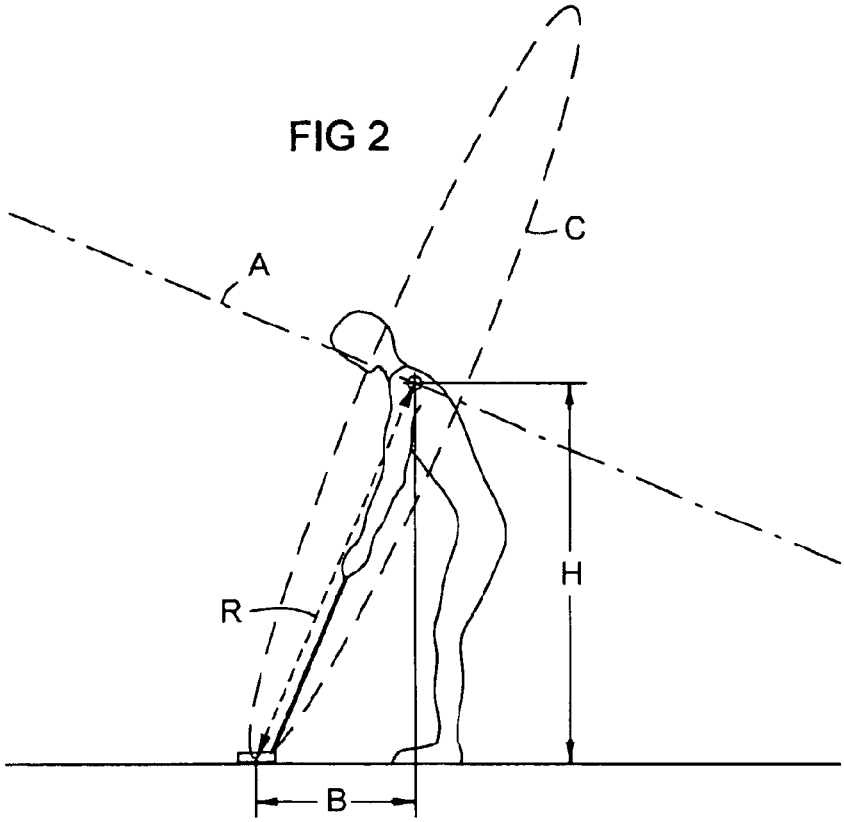
FIG. 2 is a side view of the guided golf swing geometry.

The invention is a golf putting stroke guide that holds a putting club, and only allows a single degree of freedom, which is rotation about an axis A. The axis is adjustable as to height and vertical angle during setup so that it passes between a golfer's shoulders in a putting stance. A pivoting guide arm 4 holds the putting club shaft 23 in a clamp assembly 5. Adjustments are provided to the length of the guide arm 4 and to the clamp assembly so that the putter head 21 is held just above the putting surface 1 at the golfer's chosen angle. The golfer strokes the putter in the guided swing arc, which is part of a perfect circle C as shown in FIG. 2. A ball 20 may be placed on the putting surface and struck for additional feedback from the training technique.

A base 1 is preferably provided to stabilize the support structure 2 using a golfer's weight. The support structure 2 is preferably a telescoping pole with braces 2*a* as shown. Alternately it may have bracing in the form of an A-frame for high rigidity, or it may be in a different frame shape if desired. A guide arm 4 is attached to the top of the support structure by a pivot mechanism 3. This pivot mechanism preferably has one or more low-friction bearings to make pivot resistance negligible. The guide arm 4 is preferably light and rigid, such as tubular aluminum, graphite composite, or other light, stiff material. However, steel, plastic tubing, or other materials can be used for reduced cost.

Figure 3:
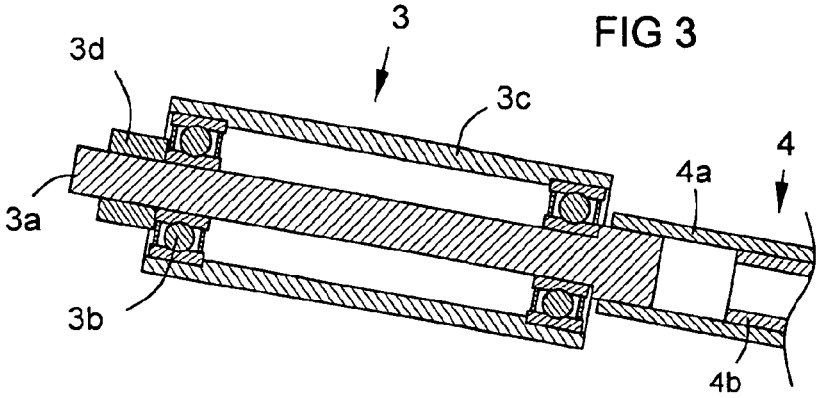
FIG. 3 is a side sectional view of the guide arm pivot.

The guide arm 4 has a lower end 4*d* with a clamp assembly 5 that holds a golf club shaft rigidly with respect to the guide arm. The club cannot twist or cock relative to the guide arm 4. Adjustments are provided to accommodate different club sizes and angles. This allows a golfer to use a preferred club and assume his or her preferred putting stance FIG. 2 shows the geometry of the golf stroke that is trained by this device. The club head follows an arc that is part of a perfect circle C centered on a point between the golfer's shoulders. There is no wrist cocking or twisting during the stroke. FIG. 3 shows a side sectional view of the guide arm pivot 3. It preferably has low friction bearings 3*b*.

Figure 4:
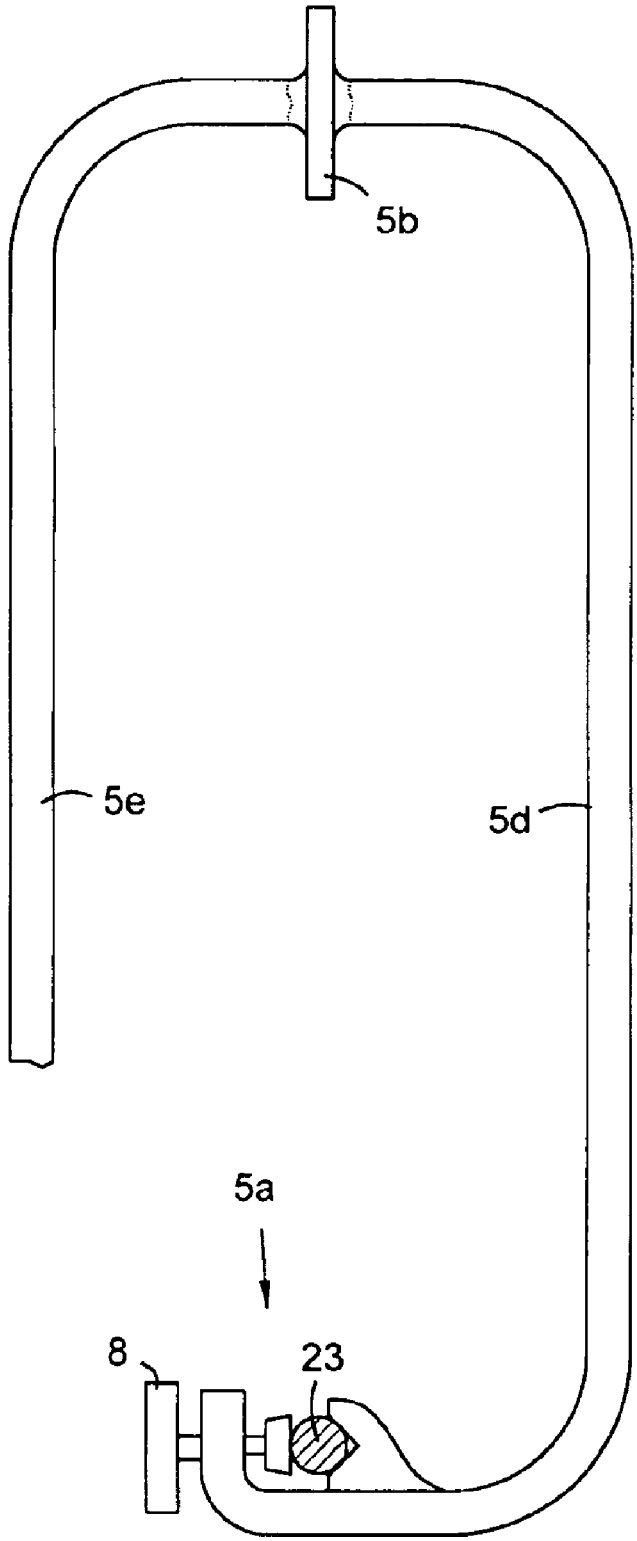
FIG. 4 is a top view of the club shaft clamp arms and junction plate, with the lower offset arm partially removed for clarity.

FIG. 4 shows a top view of a suggested type of golf club shaft clamp assembly 5. The club shaft is inserted into two clamps 5*a* and fixed by means of threaded knobs 8 or other known means. The clamps are mounted on the ends of two arms 5*d*. These arms are offset laterally, for example generally in a "C" shape as in FIG. 4, to avoid blocking the golfer's vision of the club head. Various arm configurations are possible. The arms may be offset in opposite directions as shown, or both arms may be offset in the same direction, or only one offset arm may be used. A single offset arm may be formed as a vertically oriented plate with one or two clamps, instead of a rod as shown.

Suggested adjustments include: A lockable angle adjustment 7–7*b* for the pivot bearing 3, including angle indicia 7*b*; a lockable angle adjustment 5*f*–5*g* for the clamp assembly 5; a fore-aft position adjustment 5*c* for the clamp assembly; a vertical position adjustment 4*d* for the clamp assembly; and a fore-aft position adjustment 4*a* for the guide arm.

In operation, a golfer selects a putting club and places it in the club shaft clamp in position for a putting stroke. Preferably, a golf ball 20 is placed on the putting/standing surface 1. The golfer assumes a stoke address stance, and adjusts the guide arm pivot 3 so that axis A passes between his/her shoulders. The height and angle of the guide arm pivot 3 can both be adjusted in relation to each other such that the perpendicular R from the club head to the axis A intersects the axis A at a point between the golfer's shoulders, or as otherwise desired. The club shaft clamp and its adjustments may remain loosely frictionally movable during adjustment of the stroke pivot axis. Then the clamp assembly adjustments are locked. The golfer now practices repeated putting strokes, with or without striking a ball.

Preferably a setup table is provided that specifies adjustments on the device based upon a golfer's height. This allows fast setups. The adjustment parameters for a given golfer height are:

1) The height of the angle adjustment joint 7 above the ground.
2) The angle of axis A relative to the vertical.
3) The distance from the vertical reference (V) line to the ball.

The clamp assembly can be arranged as desired by the golfer. The location of the golfer's hands and the angle of the putter shaft are chosen by the golfer. The desired motion is attained using the parameters 1)–3) above.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A circular arc golf stroke guide comprising:

a generally vertical support having top and bottom ends;

a pivot bearing on the top end of the support;

an axle in the pivot bearing with a single axis of rotation;

a lockable adjustment on the support that provides adjustment to the height of the pivot bearing;

a lockable adjustment on the support that provides adjustment to the angle of the pivot axis in a vertical plane;

a golf club guide arm having top and bottom ends, the top end of the guide arm attached to the pivot axle;

a golf club shaft clamp assembly on the bottom end of the guide arm that holds a golf club rigidly with respect to the guide arm in a golf stoke address position; and a lockable adjustment on the bottom end of the guide arm that provides adjustment to the angle of the club shaft clamp assembly in a vertical plane;

whereby a golf club can be clamped firmly on the bottom of the guide arm, and can only swing about the single axis with no other freedom of motion.

2. The golf stroke guide of claim 1, wherein the golf club clamp assembly comprises:

at least one clamp support arm having first and second ends, the first end of the clamp support arm attached to the bottom end of the guide arm;

a golf club shaft clamp on the second end of the clamp support arm; and the clamp support arm having a medial portion that is laterally offset from a line between the first and second ends of the clamp support arm;

whereby a golf club having an upper end with a grip and a lower end with a head can be clamped on the second end of the clamp support arm in a putting position, and a golfer holding the golf club in a putting stance can see the club head without obstruction from the clamp support arm.

3. The golf stroke guide of claim 2, wherein the golf club clamp assembly comprises:

first and second clamp support arms, each clamp support arm having first and second ends, the first end of each clamp support arm attached to the bottom end of the guide arm;

a golf club shaft clamp on the second end of each clamp support arm;

the first clamp support arm having a medial portion that is laterally offset in a first direction from a line between the first and second ends of the first clamp support arm; and the second clamp support arm having a medial portion that is laterally offset in a second direction from a line between the first and second ends of the second clamp support arm, the first and second offset directions being generally opposite;

whereby a golf club having an upper end with a grip and a lower end with a head can be clamped on the second ends of the clamp support arms in a putting position, and a golfer holding the golf club in a putting stance can see the club head without obstruction from the clamp support arms.

4. A method of golf stroke training, comprising the steps of:

a) providing a golf stroke guide as in claim 1;

b) providing a golf club having a shaft, an upper grip, and a lower head;

c) placing the golf club in the club shaft clamp in a golf stroke address position, and lightly partially tightening the clamp and its angle adjustment;

d) positioning a golfer in a golf stroke address position holding the golf club grip;

e) adjusting the height and angle of the pivot bearing such that a perpendicular line from the club head to the pivot axis meets the pivot axis between the golfer's shoulders;

f) locking the club shaft clamp and its angle such that the club is rigid with respect to the guide arm; and g) the golfer making repeated putting stokes with the club;

whereby the club motion is restricted to a circular arc by the stroke guide.

* * * * *